US010550655B2

(12) United States Patent
Jones et al.

(10) Patent No.: US 10,550,655 B2
(45) Date of Patent: Feb. 4, 2020

(54) SYSTEM AND METHOD FOR A PRESSURE COMPENSATED CORE

(71) Applicant: Halliburton Energy Services, Inc., Houston, TX (US)

(72) Inventors: Christopher Michael Jones, Houston, TX (US); Darren Gascooke, Houston, TX (US); Anthony Van Zuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

(21) Appl. No.: 15/558,951

(22) PCT Filed: Sep. 30, 2016

(86) PCT No.: PCT/US2016/054962
§ 371 (c)(1),
(2) Date: Sep. 15, 2017

(87) PCT Pub. No.: WO2018/063385
PCT Pub. Date: Apr. 5, 2018

(65) Prior Publication Data

US 2018/0245415 A1 Aug. 30, 2018

(51) Int. Cl.

| | |
|---|---|
| ***E21B 25/10*** | (2006.01) |
| ***E21B 34/06*** | (2006.01) |
| ***E21B 47/06*** | (2012.01) |
| ***E21B 49/06*** | (2006.01) |

(52) U.S. Cl.
CPC ..... *E21B 25/10* (2013.01); *E21B 34/06* (2013.01); *E21B 47/065* (2013.01); *E21B 49/06* (2013.01); *E21B 47/06* (2013.01)

(58) Field of Classification Search
CPC combination set(s) only.
See application file for complete search history.

(56) References Cited

U.S. PATENT DOCUMENTS

| | | | |
|---|---|---|---|
| 2009/0166088 | A1 | 7/2009 | Jeffryes et al. |
| 2010/0126266 | A1 | 5/2010 | Coenen |
| 2014/0367086 | A1 | 12/2014 | Arian et al. |
| 2015/0268314 | A1 | 9/2015 | Peterson |
| 2016/0194928 | A1 | 7/2016 | Delmar et al. |

FOREIGN PATENT DOCUMENTS

| | | | |
|---|---|---|---|
| WO | 2015016928 | A1 | 2/2015 |

OTHER PUBLICATIONS

International Search Report and Written Opinion dated Jun. 26, 2017; International PCT Application No. PCT/US2016/054962.
European Search Report dated Jun. 13, 2019; European Patent Application No. 16918074.2.

*Primary Examiner* — Taras P Bemko
*Assistant Examiner* — Ronald R Runyan
(74) *Attorney, Agent, or Firm* — McGuireWoods LLP

(57) ABSTRACT

The disclosed embodiments include a core sampling system. The core sampling system includes a core barrel that in operation receives a core sample from a well. Additionally, the core sampling system includes an isolated pressure compensation system, and a selectively activated isolation mechanism coupled between the core barrel and the isolated pressure compensation system. Further, the core sampling system includes a controller that in operation deactivates the selectively activated isolation mechanism upon closing of the core barrel.

18 Claims, 8 Drawing Sheets

SYSTEM AND METHOD FOR A PRESSURE COMPENSATED CORE

BACKGROUND

The present disclosure relates generally to core sampling systems, and, more specifically, to systems and methods for pressure compensating core samples after collection.

Core sampling systems are often used in hydrocarbon producing wells to transport core samples from the well up to a surface of the well. A conventional core sampling system may transport the core samples to the surface without accounting for changes in pressure acting on the core sample as the core sample is transported. For example, a reduction in temperature, which occurs as the core sample travels to the surface, results in a thermal contraction of fluid within the core sample. This thermal contraction may lead to fluid phase changes within the core sample, and the fluid phase changes may result in irreversible fluid alteration that changes the representative nature of the core sample when compared to reservoir fluid.

Further, when gas evolves from the core sample due to changes in pressure, the gas may induce damage within the core sample. Moreover, if the fluid of the core sample contains reactive components, such as mercury or hydrogen sulfide, and the fluid of the core sample evolves from the core sample during transport to the surface, the reactive components may be chemically scavenged by a sample chamber of the core sampling system. Thus, the core sample may be further damaged by changes in the pressure acting on the core sample.

BRIEF DESCRIPTION OF THE DRAWINGS

Illustrative embodiments of the present disclosure are described in detail below with reference to the attached drawing figures, which are incorporated by reference herein, and wherein.

Figure 1:
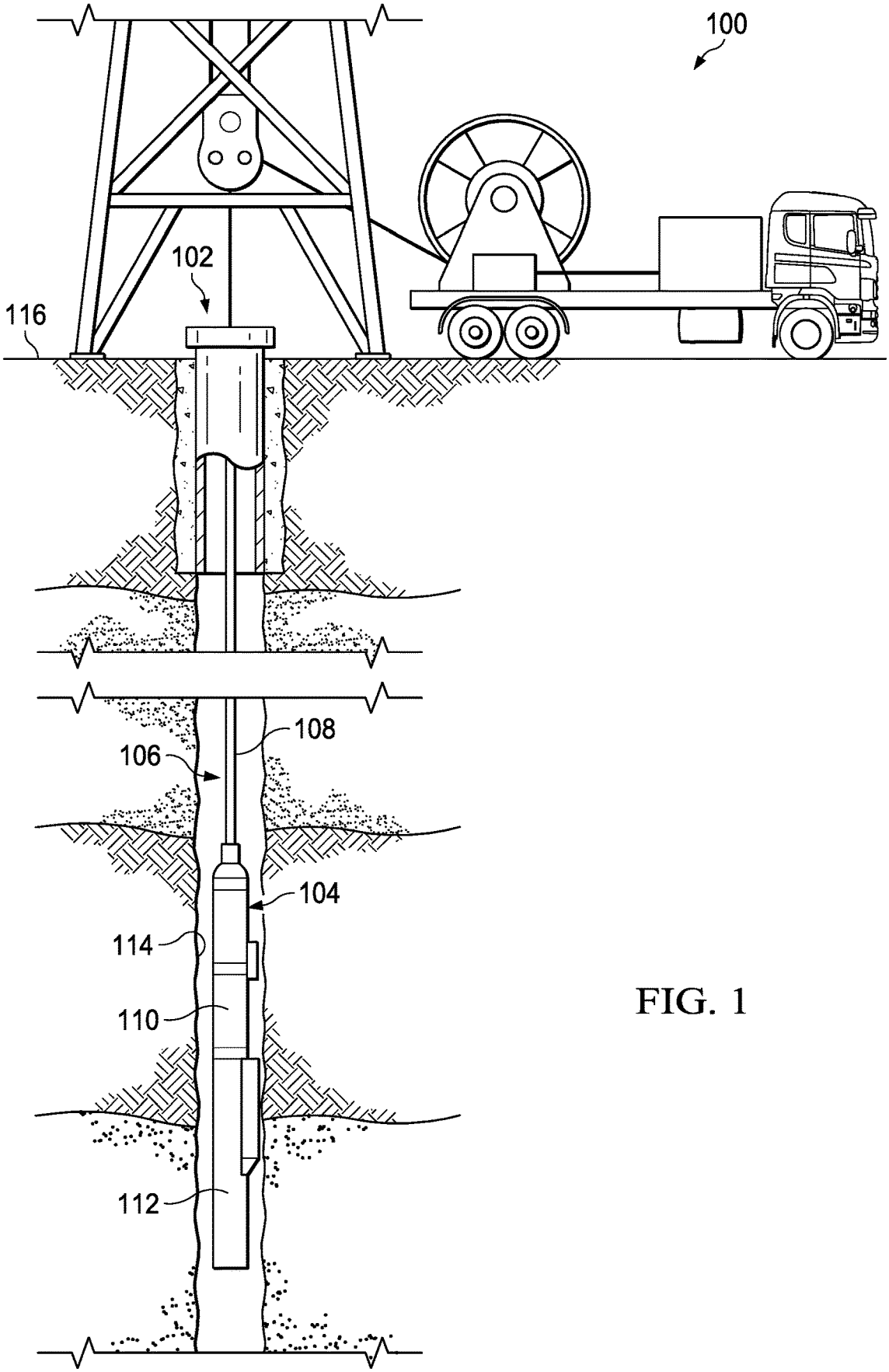
FIG. 1 is a schematic, side view of a well including a core sampling device.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a core sampling system. More particularly, the present disclosure relates to systems and methods for pressure compensating a core sample within the core sampling system. The presently disclosed embodiments may be applicable to horizontal, vertical, deviated, or otherwise nonlinear wellbores in any type of subterranean formation. Further, the embodiments may be applicable to hydrocarbon wells including injection wells and production wells. Embodiments may be implemented in which a core sampling tool is suitable for testing, retrieval, and sampling along sections of a formation through which a well is established. Further, the embodiments may be implemented with various core sampling tools that, for example, are conveyed through a flow passage in a tubular string or using a wireline, slickline, coiled tubing, downhole robot or the like. Further, devices and methods described herein, in accordance with certain embodiments, may be used in one or more of wireline, measurement-while-drilling (MWD), and logging-while-drilling (LWD) operations.

It is important to keep fluids in well samples in an original reservoir state if possible. For example, it is important to prevent fluids from transitioning between states (e.g., from gas to liquid or liquid to solid). Generally, this involves maintaining fluids above a saturation pressure and above an asphaltene onset pressure. Further, it is desirable to keep fluids within core samples by maintaining a pressure that approaches reservoir conditions on the core samples from collection through testing in a lab. That is, maintaining the pressure that approaches the reservoir conditions on the core samples prevents separation of the fluid from the core sample to prevent damage within the core sample, such as chemical scavenging or other defects that would alter test results at the surface. As discussed herein, fluid may refer to either a liquid or a gas.

Referring to FIG. 1, a schematic illustration of a side view of a hydrocarbon production environment 100 including a well 102 and a core sampling device 104 is provided. In the embodiment of FIG. 1, the core sampling device 104 is placed in a wellbore 106 by a wireline 108. In other embodiments, the core sampling device 104 may be placed in the wellbore 106 as part of a drillstring in a measurement while drilling (MWD) or a logging while drilling (LWD) operation. Additionally, the core sampling device 104 may be included on a drillpipe as part of a wired drillpipe system.

The core sampling device 104 includes a sidewall drilling tool 110 and a core barrel 112. Once the sidewall drilling tool 110 is in a region of interest in a sidewall 114 of the wellbore 106, the sidewall drilling tool 110 drills into the sidewall 114 to collect core samples. Once the core samples are collected, the sidewall drilling tool 110 inserts the core samples into the core barrel 112. Upon filling the core barrel 112, the core barrel 112 may be pressurized, as described below, to maintain a pressure environment that approximates or is near the wellbore pressure at the location where the core sample is collected while the core samples are transported to a surface 116 of the well 102. In some embodiments, a pressure within the core barrel 112 may be maintained at a pressure higher than ambient with the core barrel 112 is at the surface 116 of the well 112.

Figure 2:
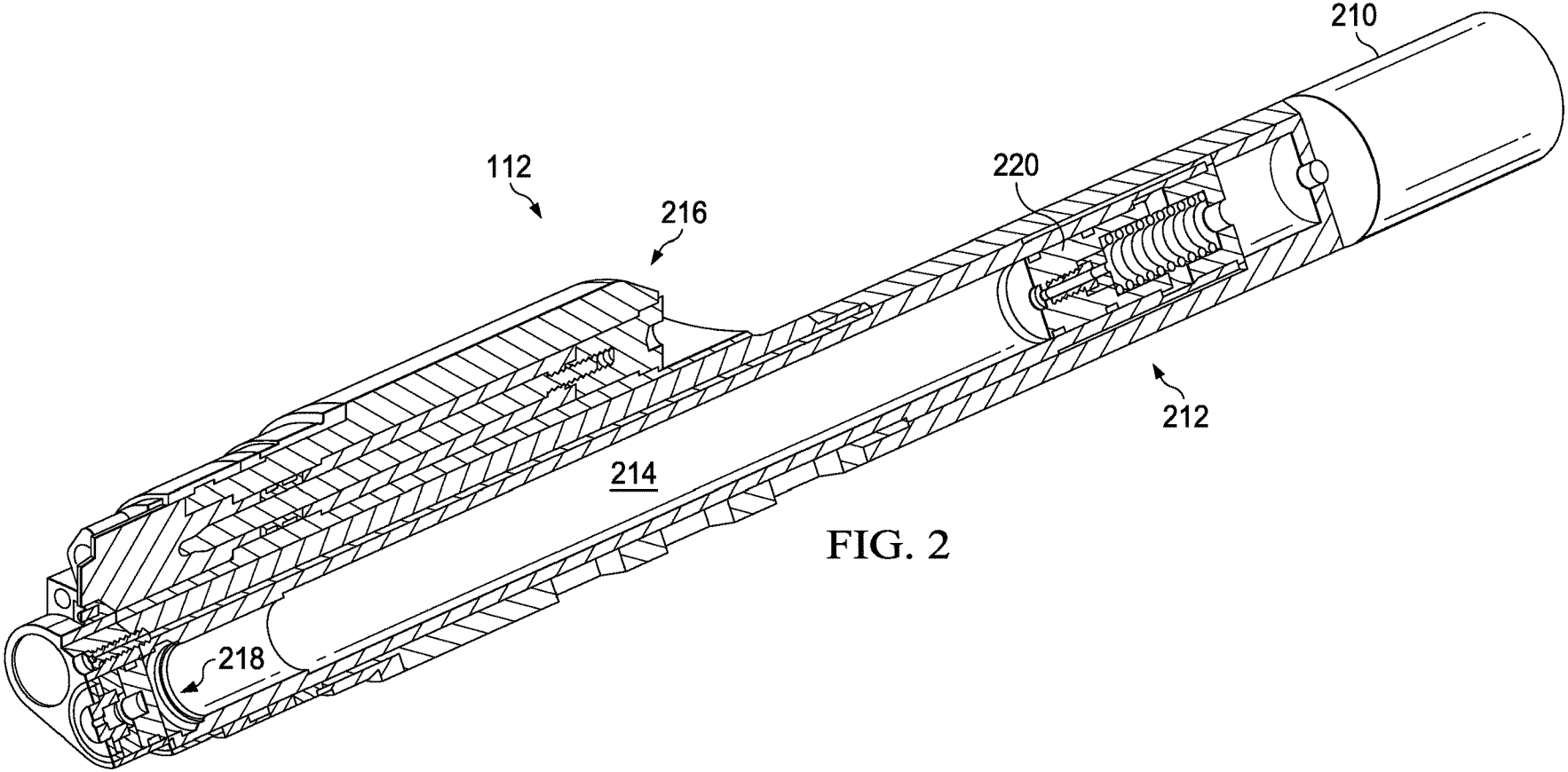
FIG. 2 is a perspective cutaway view of a core barrel of the core sampling device of FIG. 1.

FIG. 2 is a perspective cutaway view of the core barrel 112 and a pressure compensating system 210. The core barrel 112 includes a high pressure core tube assembly 212 having a carrier chamber 214 that is capable of storing a plurality of core samples. Also included in the high pressure core tube assembly 212 is a cover activator 216 that opens and closes an opening 218 of the carrier chamber 214. The cover activator 216 is described in greater detail below with reference to FIG. 3.

In certain embodiments, the core barrel 112 is a standalone assembly for use with an existing sidewall coring tool 110. The core barrel 112 stores core samples in the carrier chamber 214 after the core samples are retrieved from a formation by the side wall coring tool 110. After storing the core samples in the carrier chamber 214, the cover activator 216 provides a mechanism to close the opening 218 to maintain the high pressure environment within the carrier chamber 214, as discussed in more detail below with reference to FIG. 5.

The pressure compensating system 210 may compensate for pressure loss in the carrier chamber 214 as the core barrel 112 is transported to the surface 116 after collecting the core samples. For example, the pressure compensating system 210 may include a chamber filled with a fluid having high compressibility, such as nitrogen. In other embodiments, the pressure compensating system 210 includes an active pump, or any other pressure compensating mechanism, capable of compensating for pressure loss in the core barrel 112. When the carrier chamber 214 is closed, and the core barrel 112 begins ascending toward the surface 116, the pressure compensating system 210 may release the compressed fluid to a chamber to act on a rigid or hydraulic element of the pressure compensating system 210, as described in more detail in FIG. 5, to provide force on a piston 220 of the core barrel 112. The force provided on the piston 220 may maintain a high pressure acting on the core samples within the carrier chamber 214. For example, as pressure within the carrier chamber 214 decreases due to a reduction in temperature of the core barrel 112 as the core barrel 112 travels to the surface 116, the loss in pressure is at least partially compensated for by the pressure acting on the piston 220 provided by the pressure compensating system 210.

Figure 3:
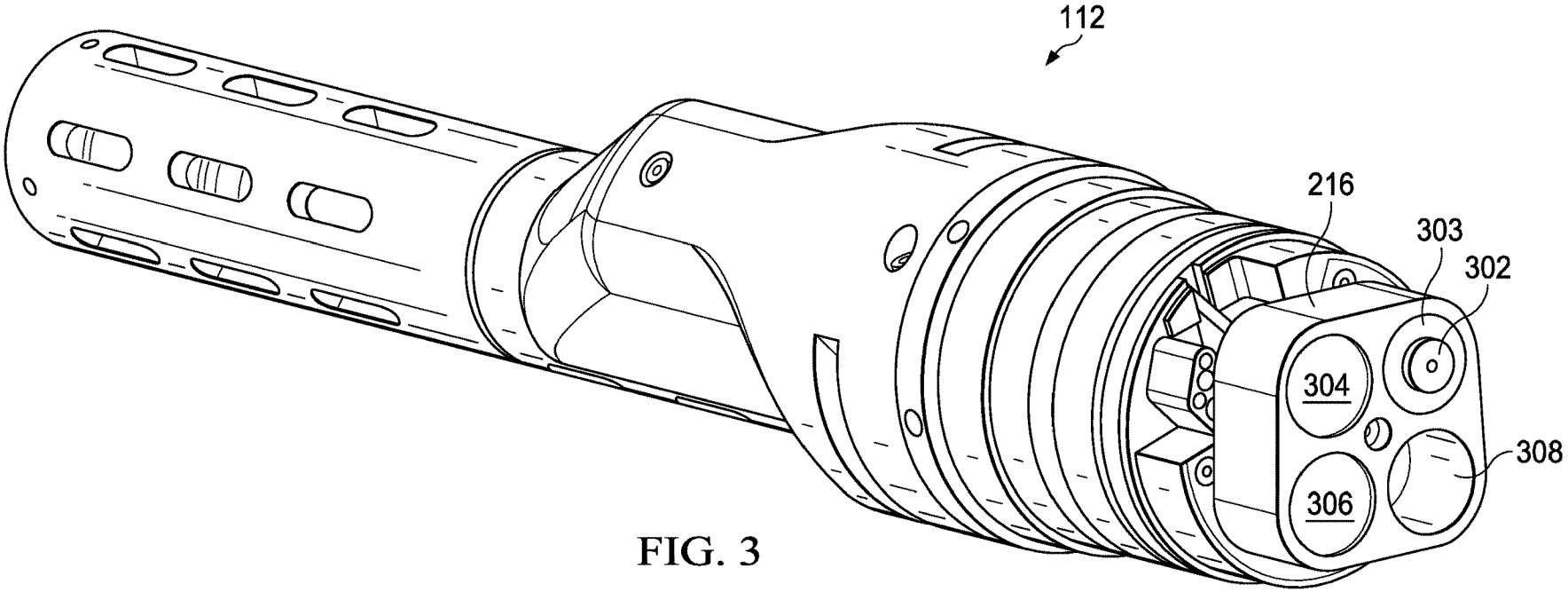
FIG. 3 is a perspective view of a cover activator of the core barrel of FIG. 2.

Referring to FIG. 3, an example of the cover activator 216 of the core barrel 112 is depicted. The cover activator 216 may be actuated to place a cover 302 within a chamber 303 or the contents of one of chambers 304, 306, or 308 over the opening 218, depicted in FIG. 2, of the core barrel 112. The cover 302 is capable of being positioned and maintaining a position within the opening 218 after the carrier chamber 214 is filled and the core barrel 112 is ready for transport to the surface 116. By way of example, the cover activator 216, as depicted in FIG. 3, includes the chamber 308 over the opening 218. The cover activator 216 may be actuated to rotate in a clockwise or counterclockwise direction to position the cover 302 or the contents of the chamber 306 over the opening 218. Other cover activators 216 may include fewer than four chambers, or the cover activators 216 may include five, six, seven, eight, nine, ten, or more chambers. The chambers 304, 306, and 308 may include isolator plugs, packaging film, or other items for preserving core samples. The cover activator 216 is actuated by a rotational motor to rotate the cover activator 216 in a clockwise or counterclockwise direction. The rotational motor may include a geared motor or a servo motor.

In an embodiment, when the sidewall coring tool 110 is in a coring mode, the chambers 303, 304, 306, and 308 of the cover activator 216 are rotated to an open position (e.g., where empty chamber 308 is positioned over the opening 218), which allows the core sample to be deposited into the carrier chamber 214. After each core sample is drilled and deposited into the carrier chamber 214, the chambers 303, 304, 306, and 308 of the cover activator 216 are rotated to a closed position. Once in the closed position (e.g., with the chamber 303 and cover 302 positioned over the opening 218), if a push rod command is activated, a push rod installs the cover 302 into the opening 218 of the carrier chamber 214. The cover 302 seals and maintains pressure of the high pressure core tube assembly 212 while the high pressure core tube assembly is brought to the surface 116 and/or transported to a laboratory for testing.

Figure 4:
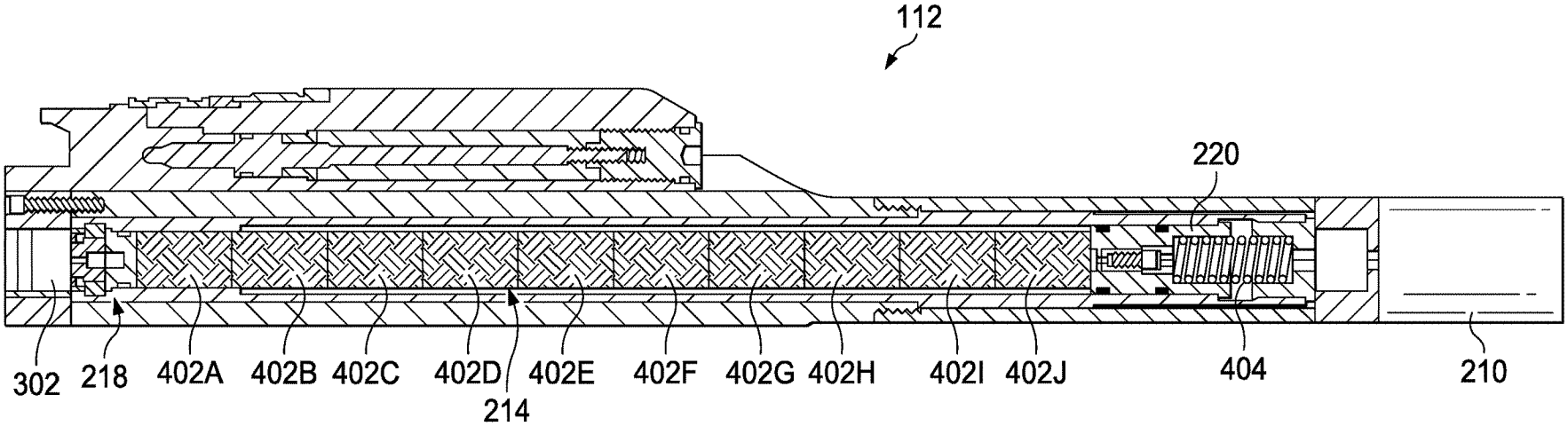
FIG. 4 is a sectional illustration of the core barrel of FIG. 2 including core samples within a carrier chamber.

FIG. 4 is a sectional illustration of the core barrel 112 showing core samples 402A-J within the carrier chamber 214. Additionally, the cover 302 is included in place over the opening 218 of the carrier chamber 214. In some implementations, the piston 220 may be compressed as the core samples 402A-J are loaded into the carrier chamber 214. The piston 220, in some embodiments, is biased by a spring 404 toward the cover 302, thereby providing resistance on the core samples 402A-J when the cores samples 402A-J are loaded into the carrier chamber 214. In some embodiments, the piston 220 may be a traveling piston or a floating piston. In such implementations, a load is maintained on the core samples 402A-J as the core samples 402A-J are brought to the surface from the pressure maintained by the travel piston.

The pressure compensating system 210 provides a pressure load on the piston 220 as the core barrel 112 is brought to the surface 116. For example, the piston 220 energized by the spring 404 may not provide sufficient force to maintain the high pressure on the core samples 402A-J as the temperature of the core barrel 112 decreases and fluids within the core samples 402A-J contract. Accordingly, the pressure compensating system 210 provides the ability to provide additional force on the piston 220 as the core samples 402A-J are brought to the surface 116.

Absent adequate pressure on the core samples 402A-J, a fluid phase change may occur because a reduction in temperature as the core barrel 112 is brought to the surface 116 causes a thermal contraction of any fluid within the core samples 402A-J. For example, thermal expansion rates for fluids are approximately 1.4E-4 (dV/V)/degree C. A standard carrier chamber 214 includes a volume of one liter, and typically the one liter volume is displaced with approximately 850 mL of core. Assuming a 0.25% porosity, a maximum of 212 mL of formation fluid is contained within the core. The formation fluid in combination with free coring fluid (e.g., buffer fluid) yields 362 mL of fluid. When a temperature of the core samples 402A-J changes from bottom hole conditions of 200 degrees Celsius to a temperature of 25 degrees Celsius at the surface 116, the fluid within the carrier chamber 214 changes in volume by approximately 8.9 mL. With a weighted average compressibility of 7.5E-6 (dV/v)/psi a 2.5% volume change is equivalent to a 3333 psi reduction of the fluid pressure for a typical case. Additionally, the pressure reduction may be more than doubled in a situation with greater porosity of the core samples 402A-J.

With this in mind, the pressure on the piston 220 provided by the spring 404 alone may not sufficiently compensate for such a large reduction in the pressure acting on the core samples 402A-J to maintain the phases of the fluids within the core samples 402A-J. Accordingly, the pressure compensating system 210, when activated, provides additional force on the piston 220 to reduce the phase changes of the fluids within the core samples 402A-J. When the carrier chamber 214 of the core barrel 112 is full, a sufficient amount of buffer fluid is included within the core barrel 112 that is capable of compression to compensate for the loss of fluid volume due to fluid contraction as the temperature decreases.

Figure 5:
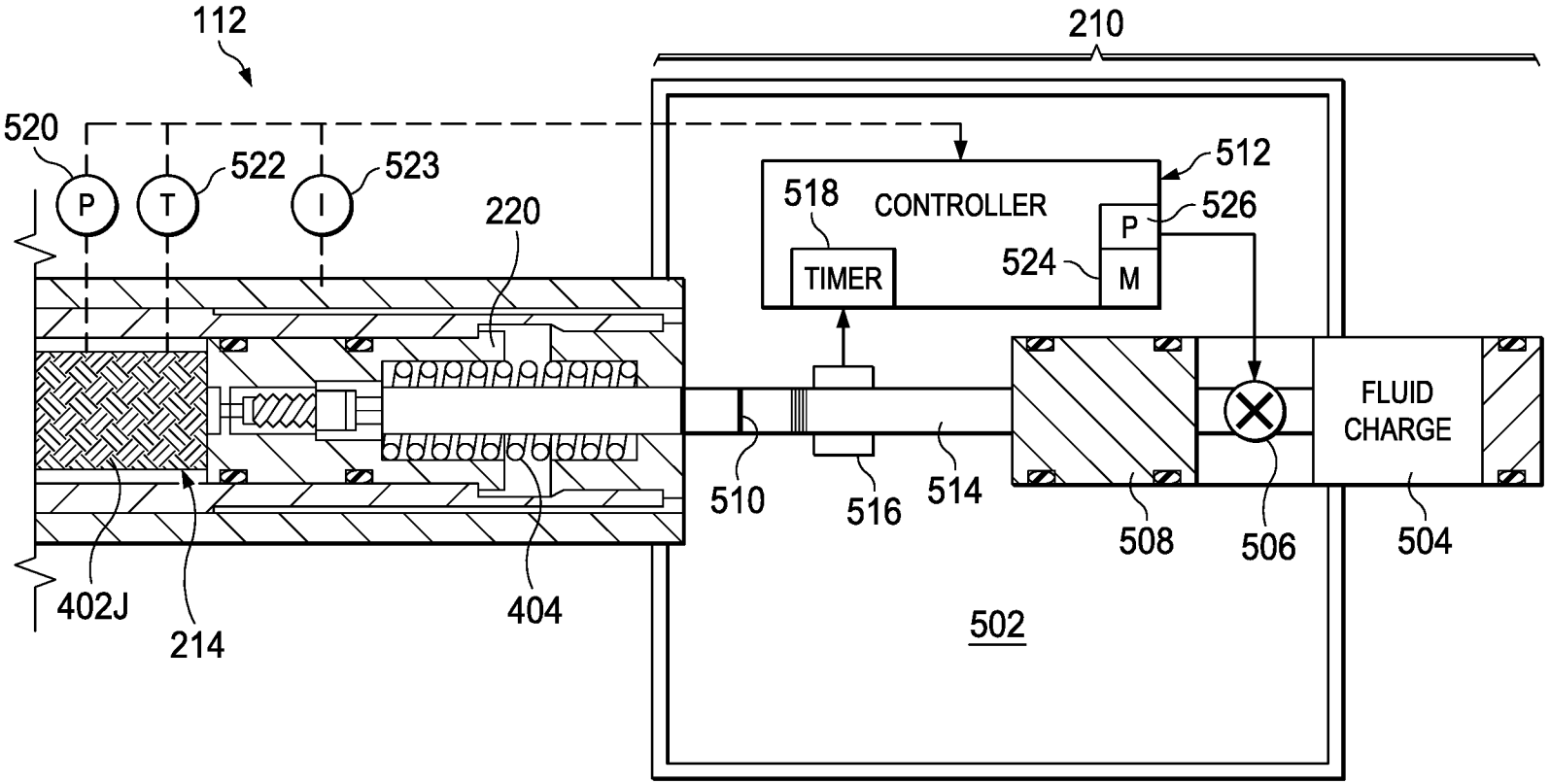
FIG. 5 is a schematic representation of a pressure compensating system coupled to a portion of the core barrel of FIG. 2.

To help illustrate, FIG. 5 is a schematic representation of the pressure compensating system 210, including a pressure compensator 502 and an isolated pressure chamber 504, including a fluid charge, coupled to a portion of the core barrel 112. Application of the fluid charge from the pressure chamber 504 is controlled by a control valve 506. That is, the control valve 506 provides selective fluid communication between the pressure chamber 504 and the piston 220. The control valve 506 may be a battery powered valve, a rupture disc, or any other suitable valve capable of withholding the fluid charge until a desired time. In some embodiments, the control valve 506 may be replaced with any other mechanism capable of isolating the pressure compensating system 210 from the core barrel 112. Additionally, actuation of the control valve 506 may be accomplished with a battery powered solenoid that opens the valve or punctures the rupture disc. Upon opening the control valve 506, the compressed fluid (e.g., nitrogen or any other highly compressible fluid) stored in the isolated pressure chamber 504 is applied to a piston 508. The piston 508 may provide a force on a rod 510 that in turn provides a force on the piston 220 of the core barrel 112. Accordingly, opening the control valve 506 increases the pressure provided on the core samples 402A-J within the carrier chamber 214.

By way of example, the isolated pressure chamber 504 may provide a force of approximately 20,000 psi directly on the piston 508. It may be appreciated that the isolated pressure chamber 504 may provide greater force on the piston 508 or lesser force on the piston 508 while still compensating for the loss of pressure within the core barrel 112 as the core barrel 112 travels to the surface 116. Additionally, as a diameter of the piston 508 increases, the pressure provided by the fluid from the isolated pressure chamber 504 may decrease to provide a same amount of force by the piston 508 on the rod 510. Further, it may be appreciated that while the isolated pressure chamber 504 is depicted as the added pressure source in the pressure compensating system 210, a spring loaded force, a mechanical drive force, or any other type of force that can provide adequate pressure on the core samples 402A-J is also contemplated. Furthermore, while FIG. 5 depicts the piston 508 rigidly connecting with the piston 220 via the rod 510, it may be appreciated that, in some embodiments, the rod 510 from the piston 508 couples hydraulically to a back portion of the core barrel 112. In turn, the hydraulic coupling acts on the piston 220 to provide the additional force on the core samples 402A-J. In another embodiment, the piston 508 couples to the piston 220 hydraulically. That is, a space between the piston 508 and the piston 220 is filled with a fluid.

The control valve 506 is controlled via a controller 512. The controller 512 may receive signals from the core barrel 112 that provide an indication to open the control valve 506. For example, as illustrated, the rod 510 includes a magnetic portion 514 and a detection coil 516 disposed around the rod 510 at the magnetic portion 514. When the cover 302 is positioned over the opening 218 of the carrier chamber 214, the spring 404 compresses and the piston 220 moves toward the pressure compensating system 210. The force of covering the opening 218 may move the spring 404 and the piston 220 approximately 0.44 inches toward the pressure compensating system 210. The movement of the spring 404 and the piston 220 moves the magnetic portion 514 of the rod 510 beyond the detection coil 516. Such movement sends a signal to a timer 518 of the controller 512. The signal begins a timer countdown, and, upon completion of the timer countdown, the control valve 506 is opened. The timer countdown is implemented to ensure that the cover activator 216 has sufficient time to position the cover 302 in the opening 218. In an embodiment, the timer countdown may be approximately five minutes, but more or less time may also be used. Further, the timer countdown may also commence when the signal to close the carrier chamber 214 is transmitted to the cover activator 216. Additionally, any other delay mechanism may also be used in place of the timer 518 to provide a delay between an indication that the carrier chamber 214 is closed and opening of the control valve 506. While the magnetic portion 514 and the detection coil 516 are described as sensing closure of the carrier chamber 214, other ways of sensing closure of the carrier chamber 214 are also contemplated. For example, movement of the rod 510 may trigger a micro-switch that indicates that the carrier chamber 214 has been closed.

The timer countdown ensures that the cover 302 is locked in position prior to the control valve 506 opening. To illustrate, if the control valve 506 is opened prior to the cover 302 locking in place, the cover 302 may not be able to lock in place due to the force provided by the fluid charge of the isolated pressure chamber 504 on the core samples 402A-J. Further, the controller 512 may include logic that does not initiate the countdown of the timer 518 until the rod 510 is displaced in a stable condition (e.g., the rod 510 is no longer moving) for a specified amount of time (e.g., for more than thirty continuous seconds). Such logic may ensure that displacement of the rod 510 is due to closing the carrier chamber 214 and not just a jarring force acting on the core barrel 112.

In some embodiments, the control valve 506 may be triggered by other signals than an open signal applied at the completion of the countdown timer. For example, a pressure sensor 520 and/or a temperature sensor 522 positioned within the carrier chamber 214 may provide signals to the controller 512 indicating the pressure and temperature within the carrier chamber 214. When either or both of the temperature and pressure within the carrier chamber 214 crosses a threshold amount, the controller 512 may instruct the control valve 506 to open. Such changes in pressure or temperature may provide an indication that the core barrel 112 is moving toward the surface 116. Accordingly, absent the magnetic portion 514 and the detection coil 516, such movement may provide an indication that the core barrel 112 has closed and applying pressure from the fluid charge of the isolated pressure chamber 504 is desired. Additionally or alternatively, the core barrel 112 may also be equipped with an inertia sensor that provides data regarding movement of the core barrel 112 to the controller 512. When the inertia sensor 523 indicates that the core barrel 112 is moving toward the surface 116, the movement indication may result in the controller 512 instructing the control valve 506 to open.

Moreover, in an embodiment, during a countdown by the timer 518, the pressure sensor 520 or the temperature sensor 522 may detect changes that indicate movement of the core barrel 112 toward the surface 116. In such an embodiment, the controller 512 may bypass the remaining portion of the countdown and instruct the control valve 506 to open. Bypassing the remainder of the countdown and opening the control valve 506 when the temperature or pressure within the carrier chamber 214 crosses a threshold may provide the highest likelihood that the fluids within the core samples 402A-J maintain the phases associated with the original reservoir state during transport of the core samples 402A-J to the surface 116.

The controller 512 may include a memory 524 that is capable of recording the pressure and temperature observed by the pressure sensor 520 and the temperature sensor 522 when each of the core samples 402A-J are collected. Additionally, the memory 524 may record times at which the core samples 402A-J are collected, and pressure and temperature readings when the control valve 506 is opened. The memory may also include instructions carried out by one or more processors 526 that provide control of the pressure compensating system 210.

The control valve 506 may also be opened by receiving a signal from the surface 116. For example, an operator at the surface 116 may instruct the control valve 506 to open upon an amount of time passing after instructing the core barrel 112 to close. The signal from the surface 116 may be sent electrically by way of the wireline 108 using analog or digital signals. Additionally or alternatively, the signal may be communicated wirelessly, as with an acoustic signal, a bulk pressure based signal, or a temperature based signal.

Figure 6:
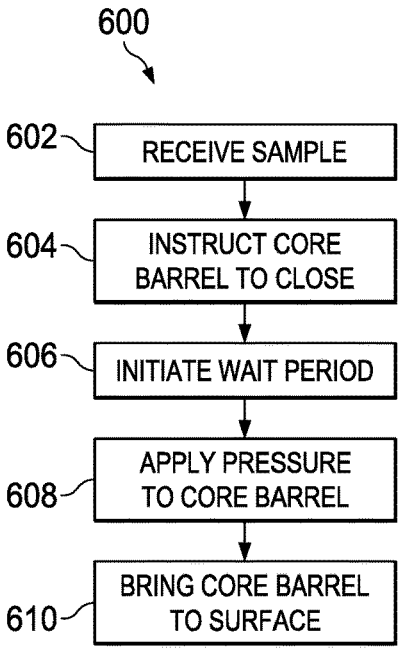
FIG. 6 is a flow chart of a method for compensating for pressure loss in the core barrel of FIG. 2.

FIG. 6 is a flow chart of a method 600 for compensating for pressure loss in the core barrel 112 as the core barrel 112 travels to the surface 116. Initially, at block 602, the core samples 402A-J are received within the carrier chamber 214. The core samples 402A-J may be collected at various depths within the wellbore 106. Further, while FIG. 4 of the present disclosure depicts ten core samples, more or fewer core samples 402 are also envisioned as being collected by the core barrel 112. For example, in an embodiment, the core barrel 112 may collect as few as one core sample 402. In another embodiment, the core barrel 112 may collect upwards of twenty core samples 402.

Subsequently, at block 604, the core barrel 112 is instructed to close the carrier chamber 214. As discussed with reference to FIG. 3, instructions to close the carrier chamber 214 may involve instructions to the cover activator 216 to place the cover 302 over the opening 218 to lock the core samples 402A-J within the carrier chamber 214. Further, the instructions to close the carrier chamber 214 may be provided by an operator at the surface via wireline communications or via wireless acoustic communications. Alternatively, the instructions to close the carrier chamber 214 may be automatic when the carrier chamber 214 reaches capacity.

When the carrier chamber 214 is closed, the piston 220 may displace the rod 510 in such a manner to send a signal to the controller 512 to initiate a wait period at block 606. In an embodiment, the wait period is established by the timer 518. The wait period may be used to ensure that adequate time has passed to close the carrier chamber 214. In other embodiments, the wait period may be bypassed when the controller 512 detects other stimuli (e.g., a change in temperature and/or pressure) that indicate to open the control valve 506.

Accordingly, at block 608, the control valve 506 is opened, and pressure is applied to the core barrel 112. By applying the pressure from the fluid charge of the isolated pressure chamber 504 to the core barrel 112, the fluids within the core samples 402A-J may be maintained at phases of the reservoir state. That is, pressure within the carrier chamber 214 that is lost while bringing the core barrel 112 to the surface, at block 610, is compensated for by the additional pressure provided by the fluid charge of the isolated pressure chamber 504.

Figure 7:
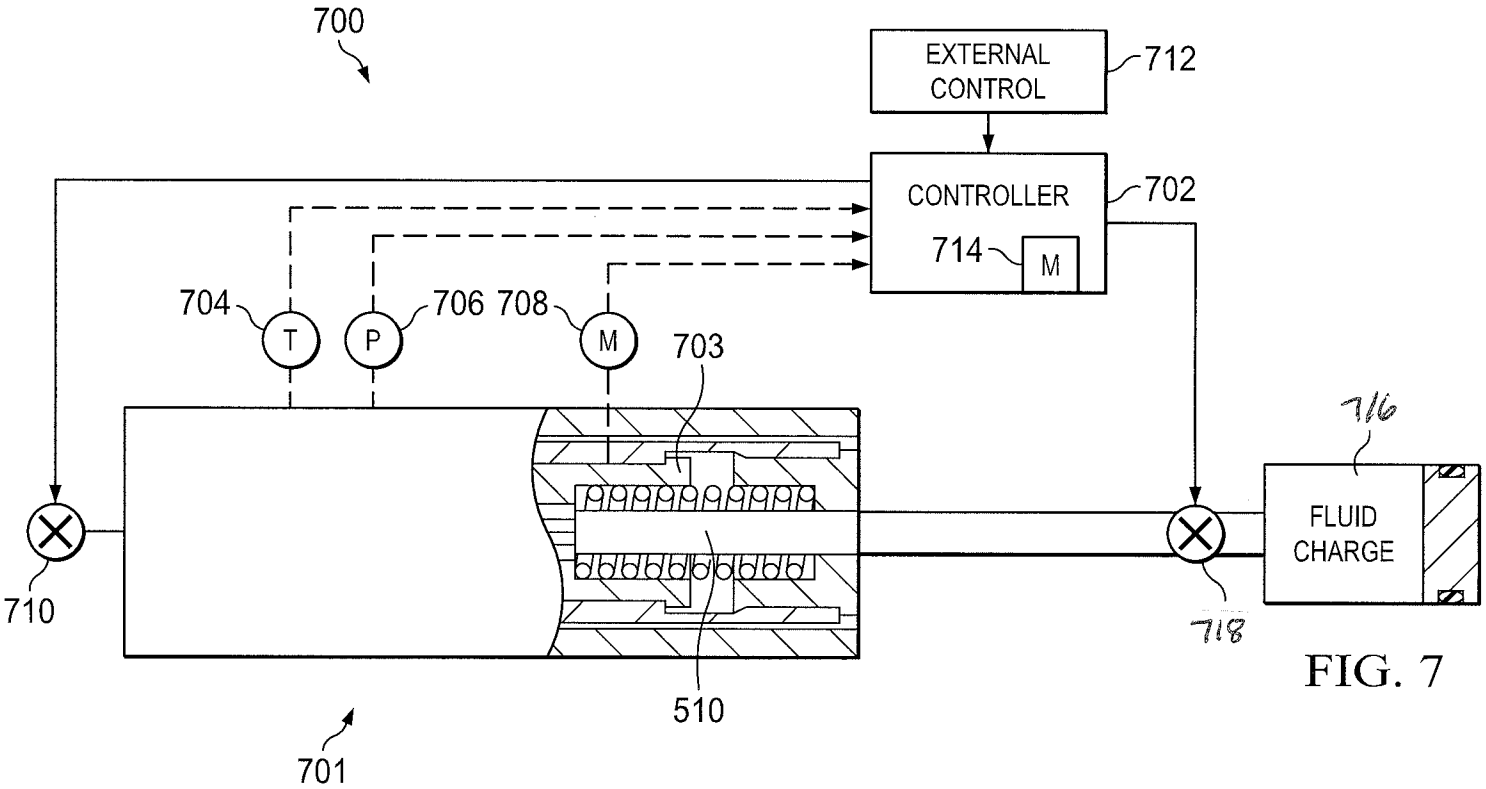
FIG. 7 is a schematic representation of a system for maintaining a fluid sample barrel at or near reservoir pressure.

FIG. 7 is a schematic representation of a system 700 for maintaining a fluid sample barrel 701 at or near reservoir pressure while transporting the fluid sample barrel 701 to the surface 116. A controller 702 controls the controls application of the fluid charge of the isolated pressure chamber 716 to a piston 703 of the fluid sample barrel 701 by opening the control valve 718. The fluid charge of the isolated pressure chamber 716 and the control valve 718 may operate in a similar manner to the isolated pressure chamber 504 and the control valve 506 described above in the discussion of FIG. 5. The controller 702 may receive inputs from a temperature sensor 704, a pressure sensor 706, and/or a magnetic sensor 708 disposed within or near the fluid sample barrel 701.

The magnetic sensor 708 may detect a magnet disposed within the piston 703 as the fluid sample barrel 701 fills and the piston 703 travels in a direction toward the isolated pressure chamber 504. The magnetic sensor 708 may be positioned along the fluid sample barrel 701 in an area that indicates that the fluid sample barrel 701 is full once the magnetic sensor 708 detects the presence of the magnet within the piston 703. In this manner, the magnetic sensor 708 transmits a signal to the controller 702 indicating that the fluid sample barrel 701 is full. At such a time, the controller 702 may send a signal that instructs a sample valve 710 to close, and, upon closing the sample valve 710, send an additional signal to the control valve 718 to open. Upon opening the control valve 718, the fluid charge of the isolated pressure chamber 716 applies additional force on the piston 703 to compensate for lost pressure of the fluid sample as the fluid sample barrel 701 travels to the surface 116. It may also be appreciated that, in an embodiment, the isolated pressure chamber 716 and the control valve 718 may be mechanically coupled to the fluid sample barrel 701 in a manner similar to the pressure compensating system 210 described in FIG. 5. That is, the control valve 718 opens to provide force from the fluid charge of the isolated pressure chamber 716 on a piston (not shown for clarity of illustration, but analogous to piston 508 of FIG. 5). Thine piston provides a force on the rod 510, and the rod 510 provides the force on the piston 703 within the fluid sample barrel 701.

Further, the temperature sensor 704 and the pressure sensor 706, in some embodiments, also provide inputs to the controller 702. For example, a change in temperature or a change in pressure, as indicated by the temperature sensor 704 and the pressure sensor 706, respectively, may indicate that the fluid sample barrel 701 is moving toward the surface 116. Accordingly, to preserve the fluid sample at a high pressure, the controller 702 instructs the sample valve 710 to close upon detecting the changes in temperature and/or pressure. Additionally, once the sample valve 710 is closed, the controller 702 instructs the control valve 506 to open, which results in force from the fluid charge of the isolated pressure chamber 504 being applied to the piston 703.

In another embodiment, an external control 712 may provide instructions to the controller 702 to open and close the sample valve 710 and the control valve 506. For example, the external control may be operated by an operator at the surface 116, and the operator may manually instruct the controller to close the sample valve 710 and subsequently open the control valve 506 via wireline communication and/or via wireless acoustic communication. In this manner, the operator may override any automated systems of the controller 702 (e.g., inputs from the sensors 704, 706, and/or 708 indicating that the fluid sample barrel 701 is full or moving) to close the sample valve 710 and open the control valve 506.

Also included with the controller is a memory 714. In an embodiment, the memory 714 stores the temperature, pressure, and magnetic inputs provided by the sensors 704, 706, and 708. Additionally, the memory 714 may record a time associated with the inputs and a time associated with when the samples are taken. It may also be appreciated that while a single fluid sample barrel 701 is illustrated, the system 700 may include several fluid sample barrels 701 that can all be pressurized by the fluid charge of the isolated pressure chamber 504. For example, as the system 700 travels downhole in the wellbore 106, individual fluid sample barrels 701 may collect fluid samples at depth intervals along the wellbore 106, and the controller 702 controls the sample valves 710 to open and close at the appropriate depth for each of the fluid sample barrels 701. Once the last fluid sample barrel 701 is filled and the last sample valve 710 is closed, the controller 702 may instruct the control valve 506 to open, and the fluid charge of the isolated pressure chamber 504 may apply a force on all of the individual pistons 703 associated with each of the fluid sample barrels 701.

Figure 8:
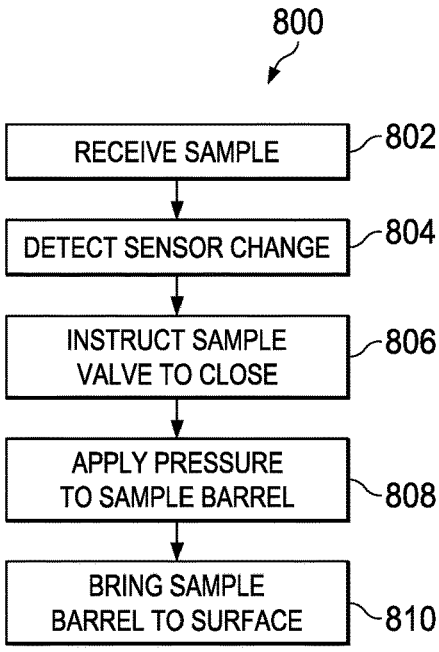
FIG. 8 is a flow chart of a method for compensating for pressure loss in the fluid sample barrel of FIG. 7.

FIG. 8 is a flow chart of a method 800 for compensating for pressure loss in the fluid sample barrel 701 as the fluid sample barrel 701 travels to the surface 116. Initially, at block 802, the fluid sample is received within the fluid sample barrel 701. The fluid samples may be collected at various depths within the wellbore 106. Further, while FIG. 7 of the present disclosure depicts a single fluid sample, more fluid samples in additional fluid sample barrels 701 are also contemplated as being collected by the system 700. For example, in an embodiment, system 700 may include five fluid sample barrels 701. In another embodiment, the system 700 may collect upwards of ten or more fluid samples in a corresponding number of fluid sample barrels 701.

Subsequently, at block 804, a sensor change is detected by the controller 702. The sensor change may be a change in temperature, a change in pressure, or an indication from the magnetic sensor 708 that the fluid sample barrel 701 is full. Once the sensor change is detected, the controller 702 instructs the sample valve 710 to close at block 806. Closing the sample valve 710 ceases collection of the fluid sample, and seals the fluid sample barrel 701.

Upon closing the sample valve 710, the controller 702 may apply pressure to the fluid sample barrel 701 by instructing the control valve 506 to open. The controller 702 may include a countdown mechanism (e.g., a wait period) that establishes a fixed amount of time between closing the sample valve 710 and opening the control valve 506. For example, the countdown mechanism ensures that enough time has passed between the controller 702 instructing the sample valve 710 to close and the sample valve 710 actually closing. By applying the pressure from the fluid charge of the isolated pressure chamber 504 to the fluid sample barrels 701, the fluid samples collected by the fluid sample barrels 701 may be maintained at phases of the reservoir state. That is, pressure within the fluid sample barrels 701 that is lost while bringing the sample barrels 701 to the surface, at block 810, is compensated for by the additional pressure provided by the fluid charge of the isolated pressure chamber 504.

Figure 9:
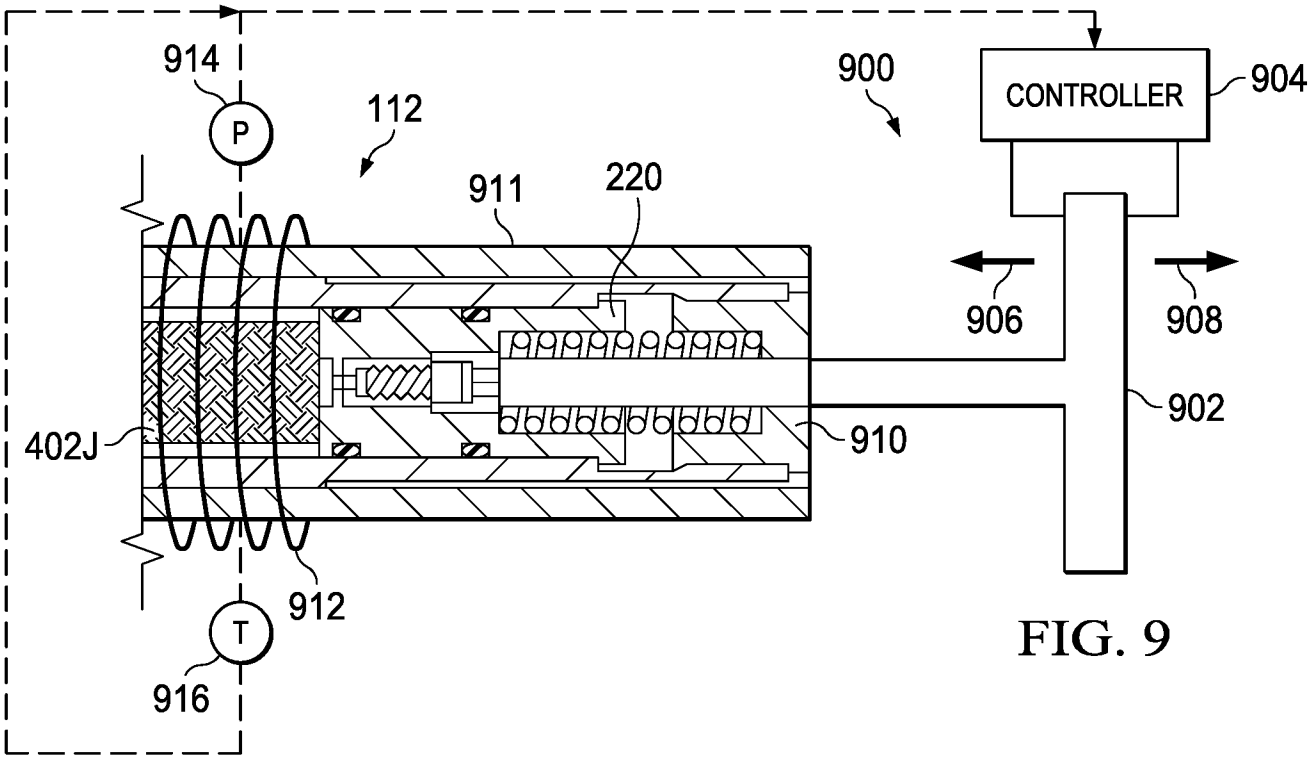
FIG. 9 is a schematic representation of a pressure, volume, temperature (PVT) testing system.

Turning to FIG. 9, a schematic representation of a pressure, volume, temperature (PVT) testing system 900 is illustrated coupled to the core barrel 112. As illustrated, the PVT testing system 900, which may be in a lab that the core samples 402A-J are sent to at the surface 116, includes a hydraulic actuator 902 and a controller 904. The controller 904 may control the movement of the hydraulic actuator 902 in a direction 906 toward the core barrel 112 or in a direction 908 away from the core barrel 112. The hydraulic actuator 902 may control the volume (e.g., the volume portion of a PVT analysis) within the core barrel 112 during a PVT analysis by removing volume in the core barrel 112 when moved in the direction 906 or adding volume in the core barrel when moved in the direction 908.

It may be appreciated that the high pressure of the core barrel 112 may be maintained as the core barrel 112 is transported to a lab by adding a locking ring 910 to the core barrel 112 to lock the piston 220 in place. That is, while the pressure compensating system 210 is coupled to the core barrel 112, the locking ring 910 fits within a base 911 of the core barrel 112 to prevent the piston 220 from moving in the direction 908 and maintain the high pressure on the core samples 402A-J. Additionally, prior to beginning the PVT analysis, the PVT testing system 900 may desire an increased base pressure for the PVT analysis. In such a situation, the hydraulic actuator 902 may move the piston 220 in the direction 906 to generate the desired base pressure, and the locking ring 910 may be moved in the direction 906 to lock the piston 220 at the desired base pressure prior to and during the PVT analysis.

Additionally, a heating mechanism 912, such as heating tape, a heating blanket, or any other mechanism capable of supplying uniform heat to the core barrel 112, is added to the core barrel 112. The heating mechanism 912 may maintain the core barrel 112 at a desired temperature during the PVT analysis. For example, the heating mechanism 912 controls the temperature portion of the PVT analysis. Further, a pressure sensor 914 and a temperature sensor 916 of the core barrel 112 may provide pressure and temperature readings to the controller 904. Using, the pressure readings, the temperature readings, and the volume (as determined by the position of the hydraulic actuator 902), the PVT testing system 900 may perform a PVT analysis on the core samples 402A-J, and pressure on the core samples 402A-J does not drop below saturation pressure or asphaltene onset pressure prior to the PVT analysis.

As an example, the saturation pressure or the asphaltene onset pressure may be approximately 4500 psi at 100 degrees Celsius, however, the saturation pressure and the asphaltene onset pressure vary depending on the makeup of the core samples 402A-J. Accordingly, any damage to or loss of representivity of the core samples 402A-J resulting from low pressures is avoided prior to lab analysis of the core samples 402A-J. It may also be appreciated that the PVT testing system 900 may be used in a similar manner on the fluid sample barrels 701.

Figure 10:
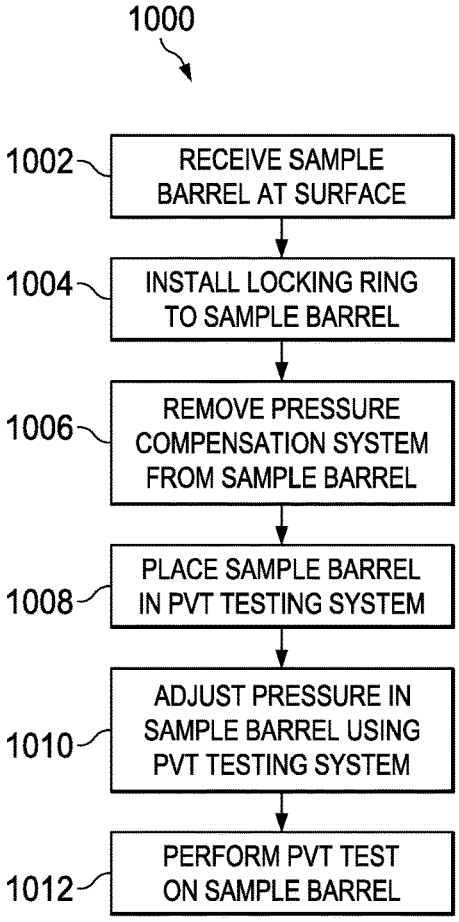
FIG. 10 is a flow chart of a method for preparing the core barrel of FIG. 2 or the fluid sample barrel of FIG. 7 for testing in a lab.

To help illustrate, FIG. 10 is a flow chart of a method 1000 for preparing the core barrel 112 or the fluid sample barrels 701 for testing in a lab. Initially, at block 1002, the core barrel 112 or the fluid sample barrels 701 are received at the surface 116. To maintain pressure on the core samples 402A-J or the fluid samples while removing the pressure compensating system 210, the locking ring 910 is installed on the barrels 112 and/or 701. The locking ring 910 maintains the samples within the barrels 112 and 701 at the pressure provided by the pressure compensating system 210.

After installing the locking ring 910, the pressure compensating system 210 is removed from the barrels 112 and/or 701 at block 1006. Removing the pressure compensating system 210 enables transport of the barrels 112 and/or 701 to a lab for PVT testing. However, it may be appreciated that, in some embodiments, the barrels 112 and/or 701 may be transported to the lab with the pressure compensating system 210 still coupled to the barrels 112 and/or 701.

Upon reaching the lab, at block 1008, the barrels 112 and/or 701 are coupled to the PVT testing system 900. At this point, a base pressure of the PVT testing system 900 may be set, at block 1010, by moving the hydraulic actuator 902 in the direction 906, and adjusting the locking ring 910 to the new base pressure setting. Upon establishing the base pressure, the PVT testing system 900 may perform the PVT analysis on the samples within the barrels 112 and/or 701 at block 1012. Further, it may be appreciated that in some instances, the pressure on the samples prior to coupling to the PVT testing system 900 may be adequate as a base pressure for PVT analysis purposes. Accordingly, in such an instance, adjusting the pressure in the barrels 112 and/or 701, as described in block 1010, may not occur.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a core sampling system, comprising: a core barrel configured to receive a core sample from a well; an isolated pressure compensation system; a selectively activated isolation mechanism coupled between the core barrel and the isolated pressure compensation system; and a controller configured to deactivate the selectively activated isolation mechanism upon closing of the core barrel.

Clause 2, the core sampling system of clause 1, wherein the selectively activated isolation mechanism is fluidly coupled between the core barrel and the isolated pressure compensation system.

Clause 3, the core sampling system of clauses 1 or 2, wherein the selectively activated isolation mechanism comprises a selectively activated valve.

Clause 4, the core sampling system of at least one of clauses 1-3, wherein the controller comprises a delay mechanism to deactivate the selectively activated isolation mechanism after the core barrel is closed.

Clause 5, the core sampling system of clause 4, wherein the delay mechanism comprises a timer that begins counting down upon the closing of the core barrel, and the controller activates the selectively activated valve when a countdown of the timer is completed.

Clause 6, the core sampling system of at least one of clauses 1-5, wherein the core barrel comprises a piston, and the piston provides a pressurizing force on the core sample when the selectively activated vale is activated.

Clause 7, the core sampling system of clause 6, wherein the controller activates the selectively activated valve upon detecting displacement of the piston resulting from the closing of the core barrel.

Clause 8, the core sampling system of clause 7, wherein the controller detects displacement of the piston magnetically.

Clause 9, the core sampling system of clause 6, wherein the controller activates the selectively activated valve upon detecting a stable displacement of the piston.

Clause 10, the core sampling system of at least one of clauses 1-9, wherein the controller activates the selectively activated valve upon detecting a change in temperature, pressure, or both at the core barrel after the core barrel is instructed to close.

Clause 11, the core sampling system of clause 10, wherein a pressure change threshold, a temperature change threshold, or both are primed when a set pressure or a set temperature is surpassed by the core barrel.

Clause 12, the core sampling system of at least one of clauses 1-10, wherein the controller deactivates the selectively activated valve based on communication from a surface of the well.

Clause 13, a method of pressure compensating one or more core samples, the method comprising: receiving the one or more core samples within a carrier chamber; sealing the carrier chamber; and moving a piston acting on the carrier chamber to change pressure within the carrier chamber.

Clause 14, the method of clause 13, wherein the piston is moved by exposing the piston to a compressed fluid source.

Clause 15, the method of at least one of clauses 13 or 14, comprising activating an isolated pressure chamber comprising a fluid charge to move the piston acting on the carrier chamber.

Clause 16, the method of clause 15, wherein activating the isolated pressure chamber comprises puncturing a rupture disc that provides selective fluid communication between the isolated pressure chamber and the piston acting on the carrier chamber.

Clause 17, a sample storage system, comprising: a high pressure barrel configured to store at least one sample collected from a well, the high pressure barrel comprising a first piston in contact with the at least one sample; an isolated pressure chamber comprising a volume of compressible fluid; a pressure compensator disposed between the high pressure barrel and the isolated pressure chamber comprising: a second piston in selective fluid communication with a portion of the high pressure barrel; and a selectively activated valve positioned between the second piston and the isolated pressure chamber; and a controller configured to activate the selectively activated valve upon closing of the high pressure barrel, wherein activating the selectively activated valve releases the compressible fluid from the isolated pressure chamber to provide pressure on the second piston, which in turn provides pressure on the first piston.

Clause 18, the sample storage system of clause 17, wherein the second piston provides pressure on the first piston via a rigid pressure transfer.

Clause 19, the sample storage system of clause 17, wherein the second piston provides pressure on the first piston via a hydraulic pressure transfer.

Clause 20, the sample storage system of at least one of clauses 17-19, wherein the controller is configured to instruct the high pressure barrel to close, and wherein the high pressure barrel closes by closing a sample valve coupled to a collecting end of the high pressure barrel.

Clause 21, the sample storage system of clause 20, wherein the controller instructs the high pressure barrel to close when the controller receives a signal indicating that the high pressure barrel is full.

Clause 22, the core sampling system of at least one of clauses 1-12, wherein the core barrel comprises a buffer fluid volume sufficient for a piston of the core barrel to compensate for fluid volume loss within the core barrel as the core barrel travels to a surface of the well.

Clause 23, the core sampling system of clause 12, wherein the communication from the surface of the well comprises a wireless signal, wherein the wireless signal is acoustic, bulk pressure based, or temperature based.

Clause 24, the sample storage system of at least one of clauses 1-12, comprising installing a locking ring on the core barrel upon removal of the core barrel from the well to maintain the one or more core samples in a pressure compensated state upon removing the isolated pressure compensation system.

Clause 25, the method of clause 13, wherein the piston is moved by increasing a fluid pressure on a side of the piston opposite the carrier chamber.

While this specification provides specific details related to certain components of a pressure compensated core barrel, it may be appreciated that the list of components is illustrative only and is not intended to be exhaustive or limited to the forms disclosed. Other components of the pressure compensated core barrel will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A core sampling system, comprising:

a core barrel configured to receive a core sample from a well; wherein the core barrel comprises a cover configured to seal the core barrel;

an isolated pressure compensation system comprising an isolated pressure chamber containing a fluid; wherein the isolated pressure compensation system is isolated from the core barrel;

a selectively activated isolation mechanism disposed between the core barrel and the isolated pressure compensation system; wherein the selectively activated isolation mechanism is coupled to the isolated pressure compensation system and prevents pressure communication between the core barrel and the fluid; and a controller configured to actuate the selectively activated isolation mechanism after sealing of the core barrel by the cover; wherein actuation of the selectively activated isolation mechanism allows for the fluid to be in pressure communication with the core barrel; wherein when the fluid is in pressure communication with the sealed core barrel, the sealed core barrel is pressure compensated to maintain a target pressure in the sealed core barrel.

2. The core sampling system of claim 1, wherein the selectively activated isolation mechanism is fluidly coupled between the core barrel and the isolated pressure compensation system.

3. The core sampling system of claim 1, wherein the selectively activated isolation mechanism comprises a selectively activated valve.

4. The core sampling system of claim 1, wherein the controller comprises a delay mechanism to actuate the selectively activated isolation mechanism after the core barrel is sealed with the cover.

5. The core sampling system of claim 4, wherein:

the delay mechanism comprises a timer that begins counting down upon the sealing of the core barrel with the cover; and the controller actuates the selectively activated isolation mechanism when a countdown of the timer is completed.

6. The core sampling system of claim 1, wherein the core barrel comprises a piston, and the piston provides a pressurizing force on the core sample when the selectively activated isolation mechanism is actuated.

7. The core sampling system of claim 6, wherein the controller actuates the selectively activated isolation mechanism upon detecting displacement of the piston resulting from the sealing of the core barrel by the cover.

8. The core sampling system of claim 7, wherein the controller detects displacement of the piston magnetically.

9. The core sampling system of claim 6, wherein the controller actuates the selectively activated isolation mechanism upon detecting a stable displacement of the piston.

10. The core sampling system of claim 1, wherein the controller actuates the selectively activated isolation mechanism upon detecting a change in temperature, pressure, or both at the core barrel after the core barrel is instructed to be sealed by the cover.

11. The core sampling system of claim 10, wherein a pressure change threshold, a temperature change threshold, or both are primed when a set pressure or a set temperature is surpassed by the core barrel.

12. The core sampling system of claim 1, wherein the controller actuates the selectively activated isolation mechanism based on communication from a surface of the well.

13. A method of pressure compensating one or more core samples, the method comprising:

receiving the one or more core samples within a carrier chamber comprising a cover and having a chamber pressure;

sealing the carrier chamber with the cover;

actuating a selectively activated isolation mechanism to allow pressure communication between the carrier chamber and a fluid charge within an isolated pressure chamber after the carrier chamber is sealed with the cover; and moving a piston acting on the carrier chamber with the fluid charge to compensate the chamber pressure within the carrier chamber; wherein the fluid charge is not in pressure communication with the carrier chamber unless the carrier chamber is sealed by the cover.

14. The method of claim 13, wherein actuating the selectively activated isolation mechanism comprises puncturing a rupture disc to allow for pressure communication between the isolated pressure chamber and the piston acting on the carrier chamber.

15. A sample storage system, comprising:

a high pressure barrel configured to store at least one sample collected from a well, the high pressure barrel comprising a first piston in contact with the at least one sample; the high pressure barrel further comprising a sample valve coupled to a collecting end of the high pressure barrel; wherein the sample valve is configured to seal the high pressure barrel;

an isolated pressure chamber comprising a volume of compressible fluid;

a pressure compensator disposed between the high pressure barrel and the isolated pressure chamber comprising:

a second piston in selective pressure communication with a portion of the high pressure barrel; and a selectively activated valve positioned between the second piston and the isolated pressure chamber; wherein the selectively activated valve prevents pressure communication between the high pressure barrel and the compressible fluid unless the high pressure barrel is sealed with the sample valve; and a controller configured to actuate the selectively activated valve upon sealing of the high pressure barrel, wherein actuating the selectively activated valve releases the compressible fluid from the isolated pressure chamber to provide pressure on the second piston, which in turn provides pressure on the first piston when the high pressure barrel is sealed to pressure compensate the high pressure barrel.

16. The sample storage system of claim 15, wherein the second piston provides pressure on the first piston via a rigid pressure transfer.

17. The sample storage system of claim 15, wherein the second piston provides pressure on the first piston via a hydraulic pressure transfer.

18. The sample storage system of claim 15, wherein the controller is configured to instruct the sample valve to seal the high pressure barrel.

* * * * *